US005842470A

United States Patent [19]

Ruben

[11] Patent Number: 5,842,470

[45] **Date of Patent: *Dec. 1, 1998**

[54] FACIAL SURGICAL MASK WITH EASIER BREATHING DEVICE

[76] Inventor: Philip H. Ruben, 505 N. Arden Dr., Beverly Hills, Calif. 90210

[ * ] Notice: The term of this patent shall not extend beyond the expiration date of Pat. No. 5,803,075.

[21] Appl. No.: 643,170

[22] Filed: May 3, 1996

[51] Int. Cl.[6] ..... A62B 7/10; A62B 18/02; A62B 23/02

[52] U.S. Cl. ..... 128/206.19; 128/206.21; 128/206.28; 128/207.11

[58] Field of Search ..... 128/206.21, 206.19, 128/206.24, 206.25, 207.28, 207.11

[56] References Cited

U.S. PATENT DOCUMENTS

| | | | |
|---|---|---|---|
| 4,966,140 | 10/1990 | Herzberg | 128/206.19 |
| 5,003,633 | 4/1991 | Itoh | 128/206.24 X |
| 5,143,061 | 9/1992 | Kaimer | 128/206.24 |
| 5,474,060 | 12/1995 | Evans | 128/204.22 |
| 5,553,608 | 9/1996 | Reese et al. | 128/206.24 |
| 5,617,849 | 4/1997 | Springett et al. | 128/206.24 |

*Primary Examiner*—Mary Beth Jones
*Assistant Examiner*—Dinh X. Nguyen
*Attorney, Agent, or Firm*—Paul J. Sutton

[57] ABSTRACT

A facial surgical mask of the type worn over the nose, mouth, chin and portions of the wearer's cheeks and held in place by one or more bands extending about the back of the head or about the ears. A first band on the inside surface of the mask attaches to the wearer's nose while a second band counterbalances the first to minimize the forces applied to the wearer's nose.

30 Claims, 8 Drawing Sheets

FACIAL SURGICAL MASK WITH EASIER BREATHING DEVICE

BACKGROUND OF THE INVENTION

1. Field of the Invention

This invention is directed to surgical masks worn by surgeons, dentists and the like and which covers the nose, mouth, chin and portions of the cheeks and more particularly to such a mask that does not interfere with the breathing of the mask wearer.

2. Description of the Prior Art

One type of prior art mask is molded of a rubber composition in the general shape of a cup. Strengthening ribs are formed across the central portion of the mask and an elasticized band is attached to the mask at diametrically located positions adjacent the mask periphery and may be placed about the wearer's head to hold the mask in the desired position. A deformable metal band is place across the outer surface of the mask at a location which will overlie the nose of the wearer. The metal band is generally deformed to fit the nose just above the flare of the nostrils to prevent inhalation of unfiltered airborne particles. However, the forces applied by the band tend to close the nostrils making breathing more difficult.

Another type of mask widely used is one made of paper and having a generally rectangular shape in its initial condition. The mask is made of a two-ply blank, fan-folded with the fold lines extending in the mask's long dimension. A border is formed along the four edges of the mask to prevent the mask being over extended by the user. The user pulls the top and bottom edges in opposite directions to extend the mask from the wearer's nose bridge to below his chin. A cord is joined to the mask along the two ends of each of the two short dimensions and each cord looped over a wearer's ear to hold the mask in place. A deformable metal band is mounted between the two plies within the top edge border. The band is also deformed about the nose above the flare of the nostrils. The manner in which such metal band is deformed may also make breathing more difficult as described above.

SUMMARY OF THE INVENTION

The instant invention overcomes the difficulties noted above with respect to the prior art surgical masks and provides a structure and teaching which can be applied to such prior art masks, and to new masks, to overcome the problems noted with respect to them. The structure constitutes an easier breathing device which can be added to existing masks or built into masks initially.

On the interior surface of the mask in the portion that will overlie the nose, there is placed a pliable, central support member in the shape of an elongated rectangle with two parallel, spaced apart surfaces. On each surface is placed a pressure sensitive adhesive. One surface is applied to the mask interior surface, while the second is attached to the exterior of the wearer's nose after the protective release layer has been removed. Between the interior surface of the mask and the one surface of the central support member that engages the interior surface of the mask is placed a support means. The support means is shorter and narrower than the central support member so that the support means is adhered to the central support member and the support means and the central support member are coupled to the interior surface of said mask by the adhesive portion beyond that covered by the support means.

The support means is made of a flexible, resilient material, such as a plastic strip, which is caused to take on an arch-type configuration when the central support member is attached to the wearer's nose. The elastic memory of the plastic strip will endeavor to restore it to its initial flat condition. By selecting the material of the support means and its dimensions, the restoration forces applied by the support member will substantially equal the forces applied to the wearer's nose by the central support member so as to cancel them out and thus not interfere with the wearer's breathing. It is an object of this invention to provide a novel facial surgical mask with an easier breathing device.

It is an object of this invention to provide a novel facial surgical mask which does not interfere with the breathing of the wearer of the mask.

It is an object of this invention to provide a mechanism which can be used with presently available facial surgical masks to improve the breathing of the wearer of the mask.

It is a further object of this invention to provide a facial surgical mask with a mechanism according to the teachings of this invention which adheres to the nose of the wearer of such mask.

It is yet another object of this invention to provide a facial surgical mask with a mechanism according to the teachings of this invention which reduces the possibility of the mask interfering with the breathing of the wearer.

It is still another object of this to provide a facial surgical mask with a mechanism according to the teachings of this invention which adheres to the nose of the wearer of such mask and which comprises a support means to counter the closing effects on the nostrils of the wearer's nose so that there is no interference with the breathing of the wearer of the mask.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawings, in which similar elements are given similar reference characters.

DESCRIPTION OF THE PREFERRED EMBODIMENTS

Figure 1:
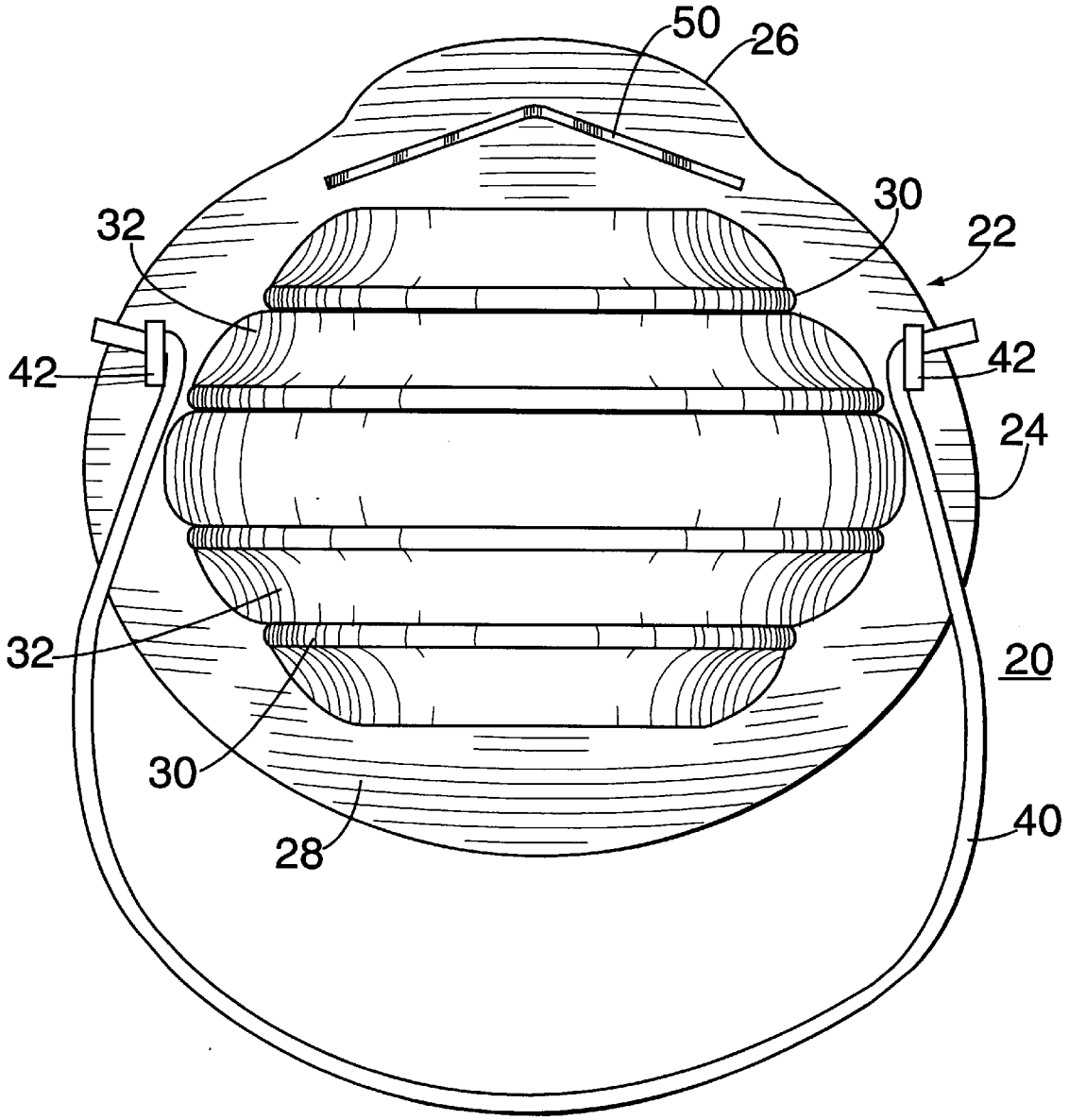
FIG. 1 PRIOR ART
FIG. 1 is a front elevational view of a molded, cone-type facial surgical mask presently available in the field.
Figure 2:
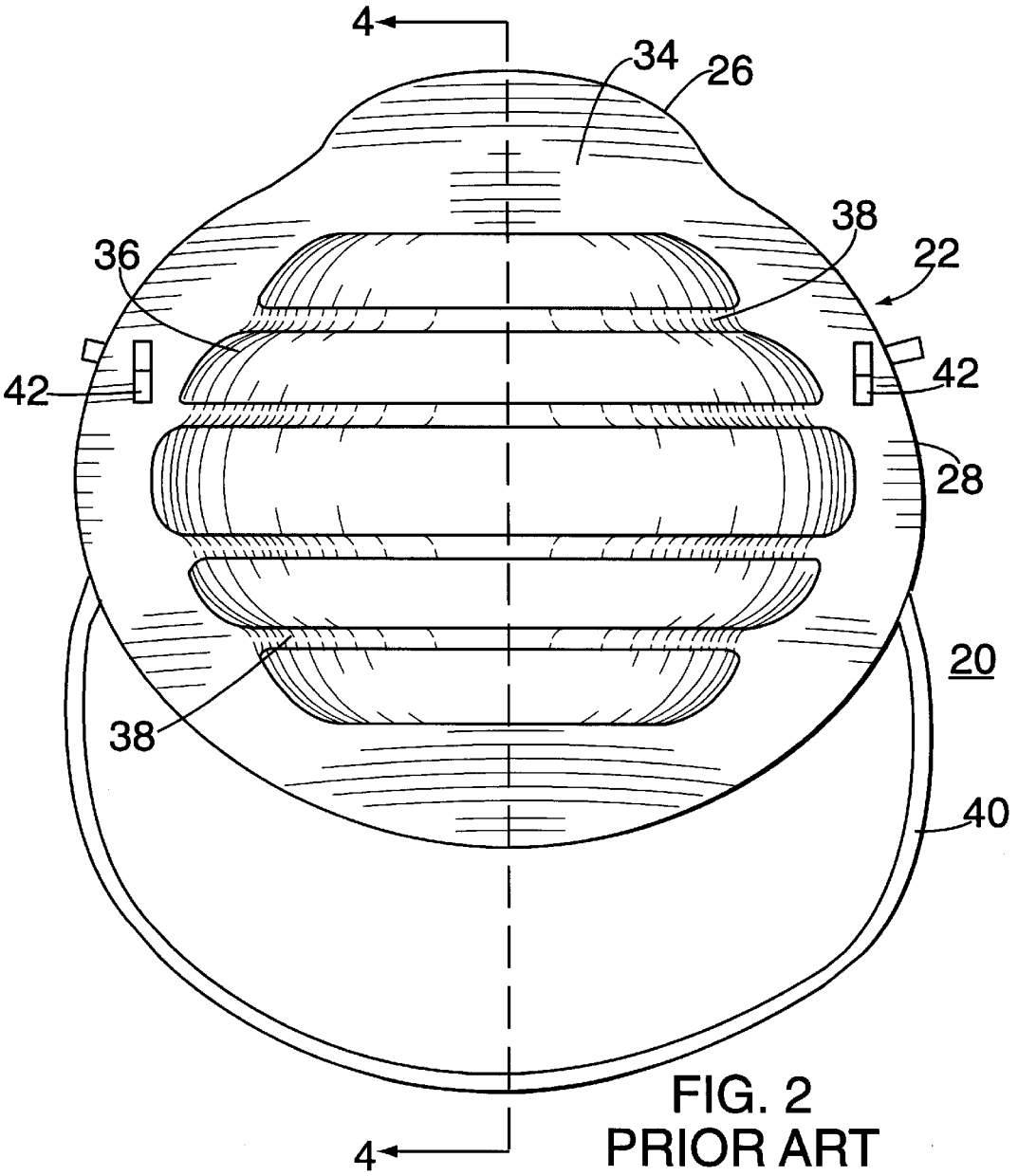
FIG. 2 PRIOR ART
FIG. 2 is a rear elevational view of the surgical mask of FIG. 1
Figure 4:
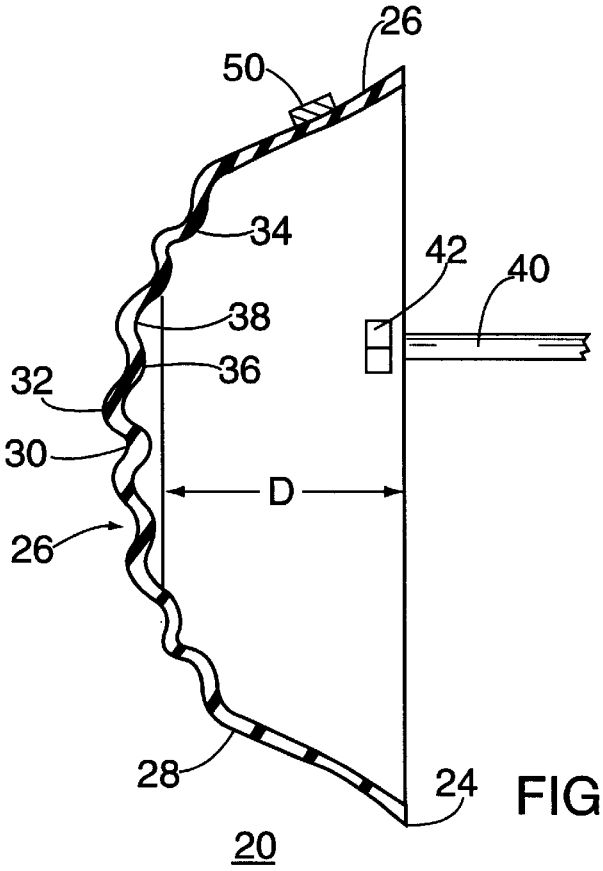
FIG. 4 PRIOR ART
FIG. 4 is a side elevational view, partly in section, of the mask of FIG. 2 taken along the line 4—4.

Turning now to FIGS. 1, 2 and 4, there is shown a cone-type facial surgical mask 20 of the type sold by 3M Company under its trademark ASEPTEX and designated 1800+Single Use Fluid Resistant Molded Surgical Mask. The mask is molded from a material which contains natural latex. It could also be fabricated from paper, cardboard or composite materials and coated with latex or other rubber materials, if desired. The body 22 has a generally cup-shaped configuration with a generally oval-shaped periphery 24. The desired position of the mask 20 is to overlay most of the wearer's nose, mouth, chin and part of the cheeks. The periphery 24 is somewhat flattened at 26 to better accept the wearer's nose. The front surface 28 of body 22 is formed with a plurality of raised strengthening ribs 30 which extend substantially across the width of body 22. Between adjacent ribs 30 are concave recesses 32. The rear surface 34 of body 22 is the reverse. Raised broad, convex ribs 36 extend between narrow recesses 38. At various points along the periphery 24, the body 22 is flared to better match the user's face. The depth of the cup, as shown by arrow D in FIG. 4, is chosen such that the rear surface 34 of body 22 does not contact the user's nose.

Figure 3:
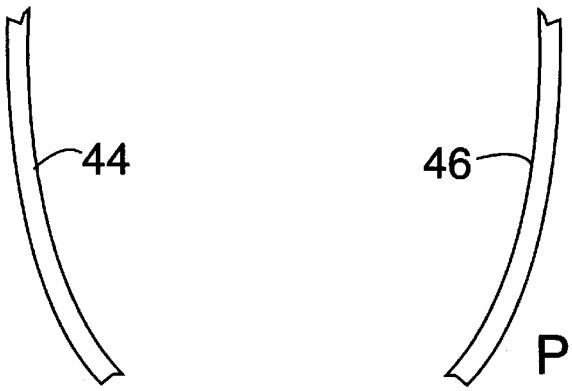
FIG. 3 PRIOR ART
FIG. 3 is a fragmentary, front elevational view of an alternative fastening means which can be used with the facial mask of FIGS. 1 and 2.

The mask 20 is held in its desired position on the wearer's face by an elastic strip 40 anchored at its ends to body 22 by metal clips 42 or the like. The length of strip 40 is too short to go about the wearer's head in its at-rest position and is stretched in order to pass over the head and then allowed to relax to securely grip the wearer's head. If desired, the single, elastic strip 40 can be replaced with two strings 44, 46, as shown in FIG. 3, which can be tied at the back of the wearer's head.

A malleable metal band 50 of aluminum or another suitable material is placed adjacent the flattened portion 26 of periphery 24 of body 22. Once mask 20 is comfortably in the desired position on the wearer's face, the wearer can distort the band 50 to conform to the wearer's nose and form a tight seal around the nose to prevent inhalation of unfiltered airborne particles. However, the tight seal about the nose to prevent entry into the mask of unfiltered airborne particles often has the effect of closing or substantially reducing the size of the nasal passages thus making it very hard for the wearer to breathe. Thus, the wearer is forced to make a choice or compromise.

Figure 5:
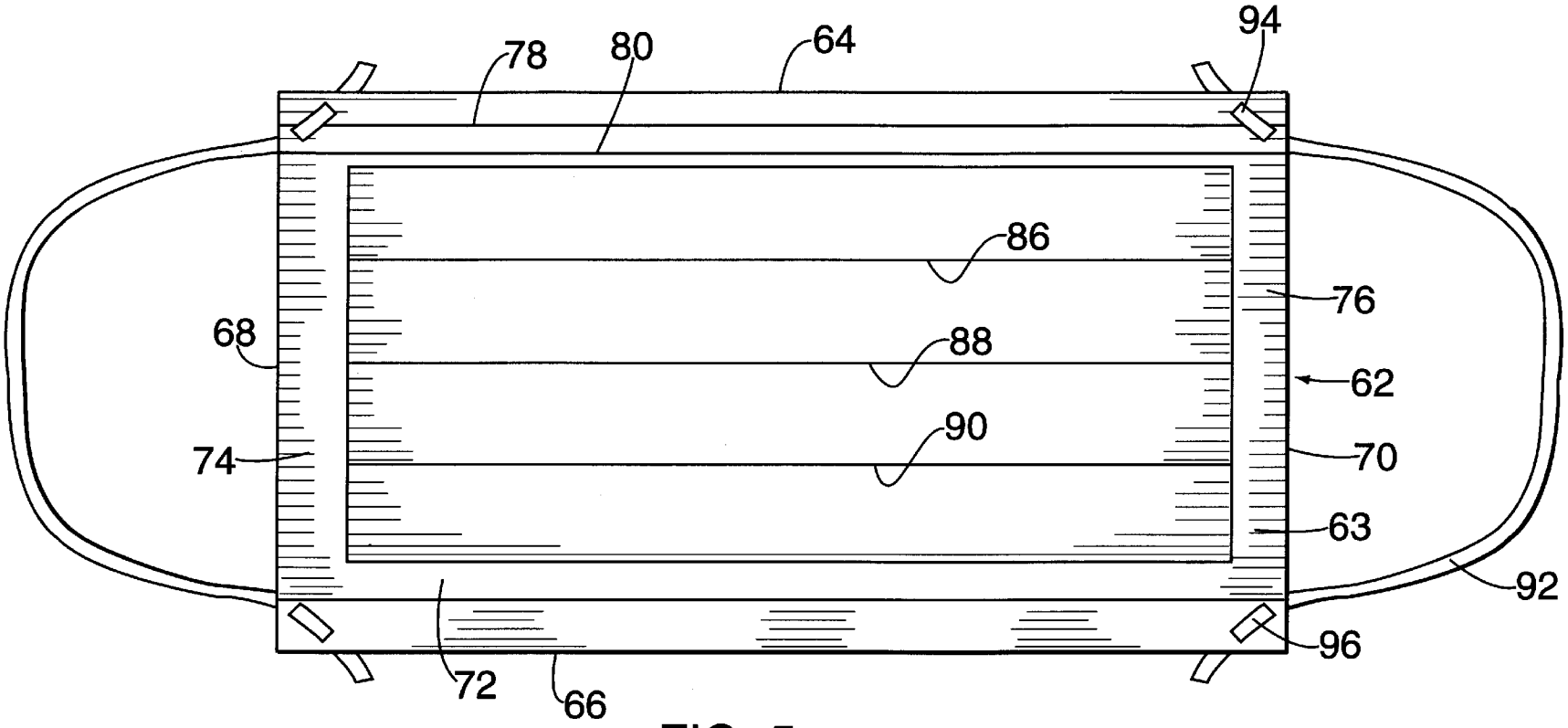
FIG. 5 PRIOR ART
FIG. 5 is a front elevational view of a rectangular-type facial surgical mask presently available in the field.
Figure 6:
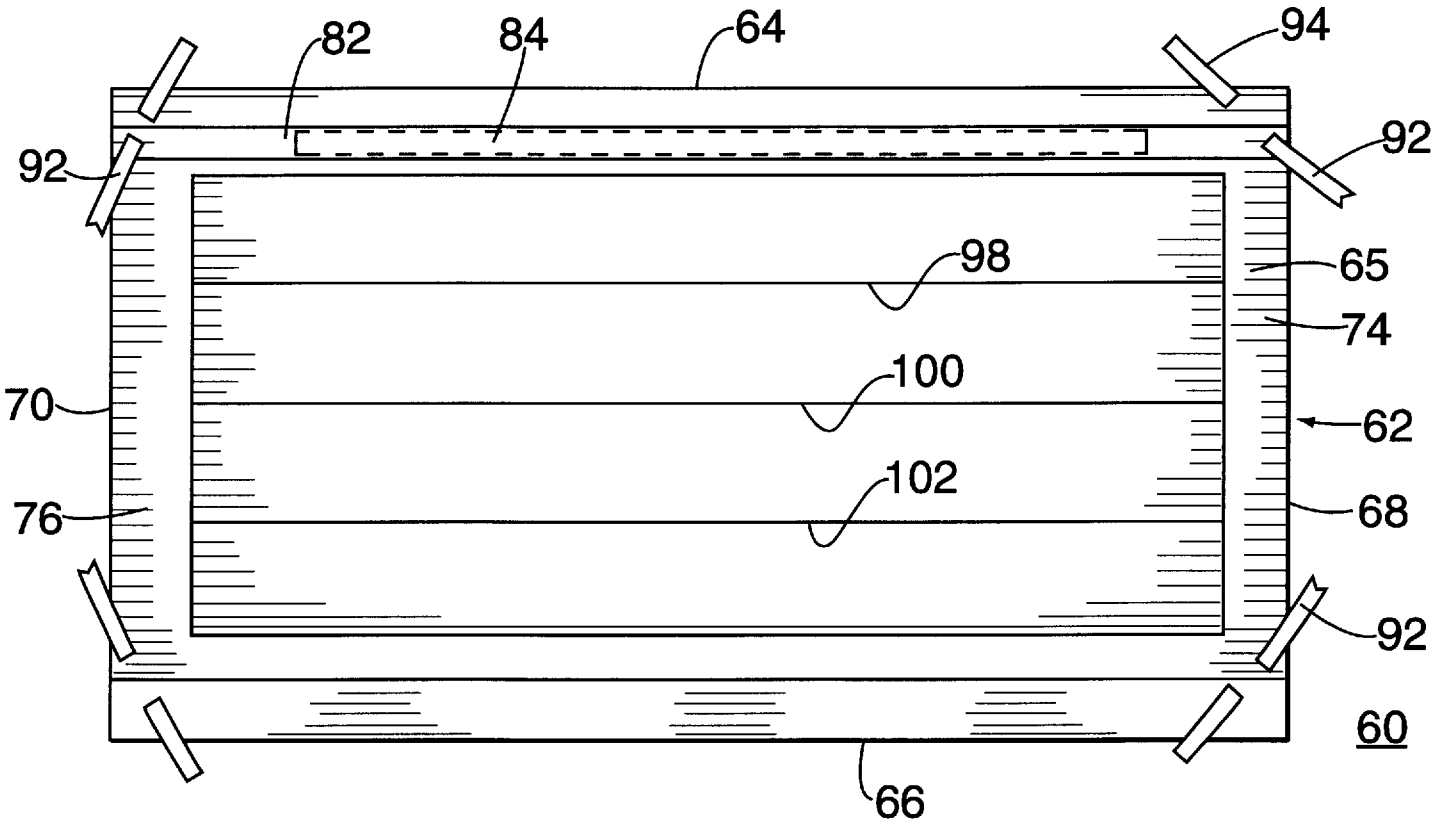
FIG. 6 PRIOR ART
FIG. 6 is a rear elevational view of the surgical mask of FIG. 5.
Figure 7:
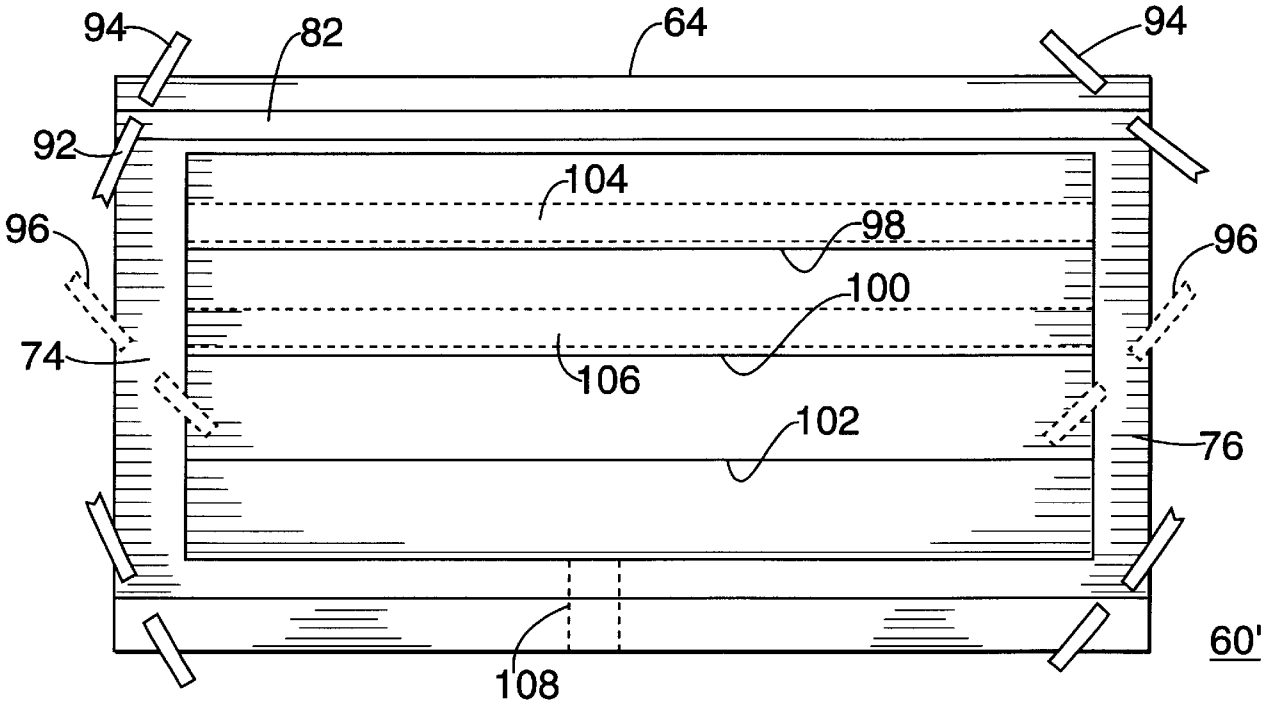
FIG. 7 PRIOR ART
FIG. 7 is a rear elevational view of a surgical mask similar to that shown in FIG. 6 and showing other construction details found on different available rectangular type masks.

Turning now to FIGS. 5, 6 and 7, there is shown a rectangular-type facial surgical mask 60 of a type presently available in the field. A version of such mask is sold by Astra USA, Inc. under the trademarks ASTRA PRO™ MAGIC ARCH® POSITIVE FACIAL LOCK® Mask. A multi-ply body 62, made of soft paper is joined adjacent its top edges 64, bottom edges 66 and side edges 68, 70. The mask could also be made of cloth or composite materials, if desired. The plies can be joined by using pressure, heat or a combination thereof and may employ a heat or chemically activated adhesive. Bottom edge 66 is continuous since it represents the folding of the web to provide two plies which make up the body 62. A zone 72, adjacent bottom edge 66, is used to further seal the plies. The plies are joined along side edges 68 and 70 by applying a sealing device in the zones 74, 76, respectively. Top edge 64 is sealed using two spaced apart, parallel sealing lines 78, 80 which provides a pocket 82 therebetween to receive a malleable metal strip 84 as is shown in phantom line in FIG. 6.

The body 62 is fan-folded flat having fold edges 86, 88 and 90 visible on front face 63 of body 62. When the mask 60 is subjected to forces operating in two opposite directions each such force applied to one of the top edge 64 or bottom edge 66, the central part of mask 60 within the zones 72, 74, 76 and 80, the mask body 62 expands so that it can fit the wearer's face from below the bridge of the nose to under the chin. The width of body 62 is such that the side edges 68, 70 cover portions of the cheeks of the wearer. The sealed edges of the body 62 do not expand but act as a pivot for the expansion of the main body 62 portion between such sealed edges. A loop 92 is joined at its ends 94, 96 to mask body 62 adjacent edge 70 and fits over one ear of the wearer. A similar loop 92 is joined at its ends 94, 96 to mask body 62 adjacent edge 68 and fits over the wearer's other ear to hold mask 60 in the desired position over the wearer's face. On the back face 65 of body 62 the fold edges 98, 100 and 102 are visible.

FIG. 7 shows some modifications of the mask 60 shown in FIG. 6. The loop 92 end 96 can be positioned closer end 94 along side zone 74 of mask 60'. The end 96 of the loop 92 in zone 76 can also be moved closer to end 94. Also, plastic strips 104, 106 (shown in phantom line) can be inserted between the plies. By choice of the plastic employed and the dimensions of such strips 104, 106 and due to the fact that the ends of strips 104, 106 are confined by the seal zones 74, 76, strip 104 will form an arch over the lower portion of the wearer's nose while strip 106 will form an arch below the nose, whereby direct contact is prevented between back face 65 of body 62 and the nose of a wearer which could block the nostrils and impede or prevent breathing. To prevent access to this area of the mask and the inhalation of unfiltered airborne particles, in addition to the previously described metal strip 84, there is a metal strip 108 (shown in phantom line) in the zone 72, which strip 108 is parallel to side edges 68, 70. This strip 108, made of a metal similar to that used for strip 84, is deformed by the wearer just behind the jaw bone to get a tight seal of the mask 60' to the face of the wearer. The deformation of strip 84 of mask 60' will have the same effect on breathing as described above.

Figure 8:
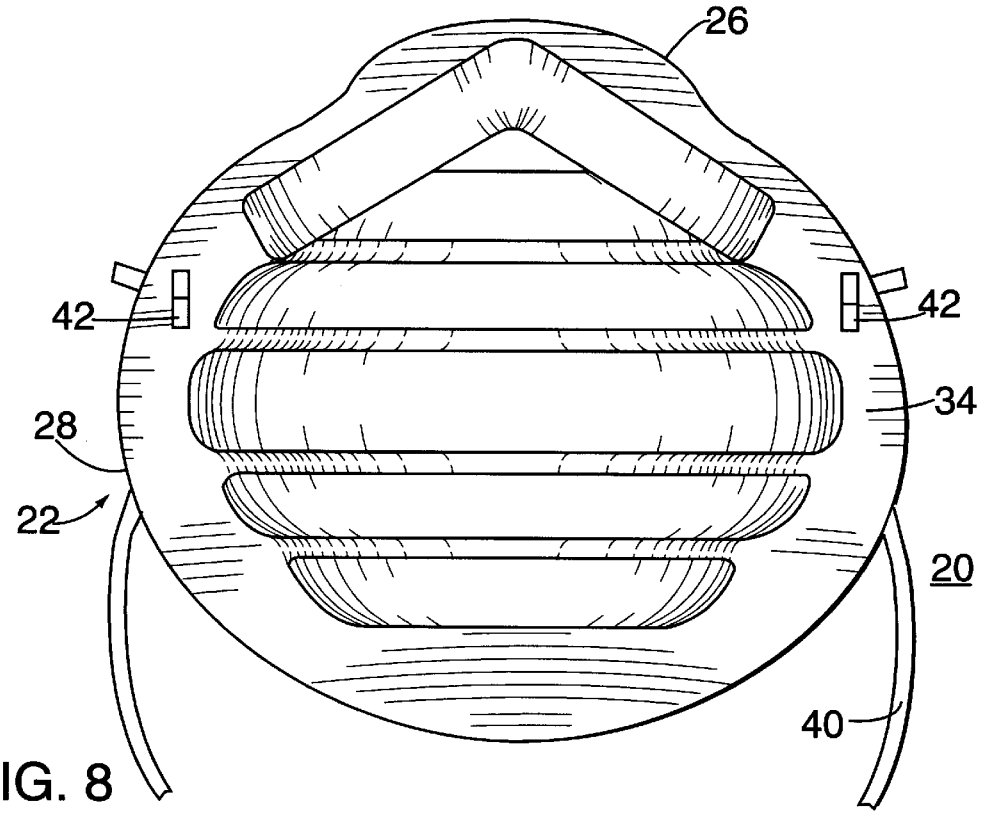
FIG. 8 is a rear elevational view of a surgical mask as shown in FIG. 2 and incorporating an easier breathing device constructed in accordance with the concepts of the invention.

Referring now to FIGS. 8 to 13, the details of easier breathing devices and their use with presently available facial surgical masks is shown. FIG. 8 shows a cone-type facial surgical mask 20 with the easier breathing device 118 installed to the rear surface 34 of body 22 adjacent the somewhat flattened portion 26 that fits over the nose of the wearer. The metal strip 50 on the front surface 28 may be removed or left in place without distortion to fit the wearer's nose.

Figure 9:
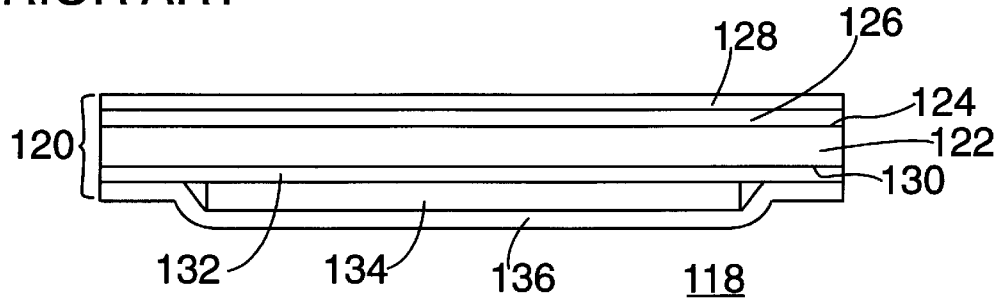
FIG. 9 is a top plan view of the component layers which make up an easier breathing device.
Figure 10:
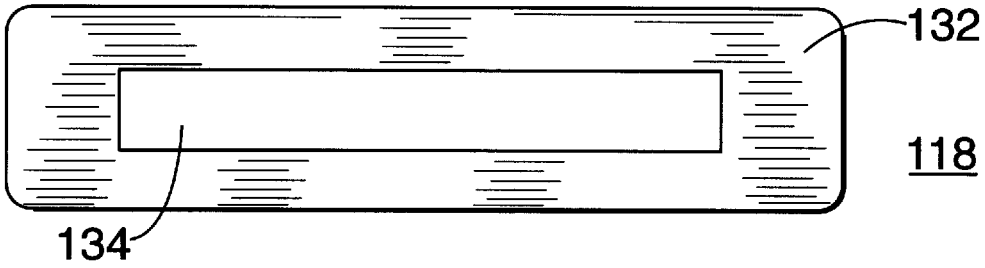
FIG. 10 is a front elevational view of an easier breathing device with the release layer removed to make certain details visible.

An easier breathing device 118, constructed in accordance with the concepts of the invention is shown in FIG. 9. An attachment means 120 has a central support means or base layer 122 of the desired length, width and thickness, which may be made of foam or other materials which are solid but pliable and can be deformed as needed without applying undue force. A closed cell foam strip was found to work well. On a first surface 124 of central support means 122 is placed a further means or a second layer 126 of a pressure sensitive adhesive which will adhere to the face of a wearer of the mask 20. This layer 126 of adhesive is covered by a release layer 128 which is removed just before the mask 20 is applied to the wearer's face. On the second surface 130 of the central support means or base layer 122 is a first layer 132 of an adhesive material. The adhesive material of first layer 132 may be a heat, light, UV-light or chemically activated or cured adhesive, or as shown, may be a pressure-sensitive layer upon which is placed support means or counter-balance strip 134. As shown in FIG. 10, the support means or counter-balance strip 134 is shorter and narrower than the first adhesive layer 132 of attachment means 120 and thus first adhesive layer 132 extends beyond the perimeter of counter-balance strip 134. A release layer 136 is placed over the first adhesive layer 132 and counter-balance strip 134 to prevent contact with the adhesive layer 132 until it is desired to mount the easier breathing device 118 on the inner surface 34 of mask 20.

Figure 11:
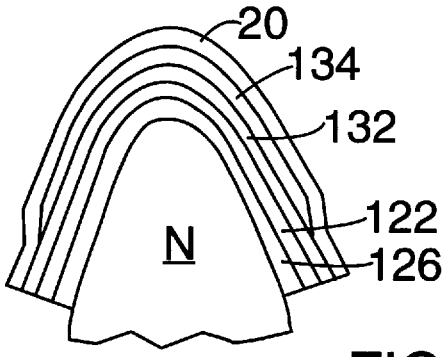
FIG. 11 is a fragmentary top view, taken along the inclined surface of a nose to which the easier breathing device mask is applied.
Figure 12:
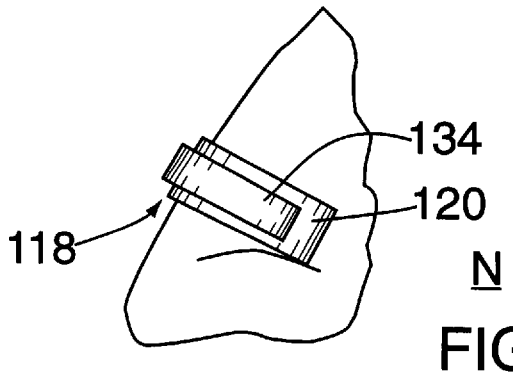
FIG. 12 is a fragmentary, simplified, side elevational view of an easier breathing device applied to a wearer's nose and with most components removed to permit a better understanding of the operation of the easier breathing device.

FIG. 11 shows the easier breathing device 118 installed to a wearer's nose N. The view is from the top but taken along the top ridge of the nose N itself. As shown by FIG. 12 the device 118 is generally perpendicular to the top ridge of the nose N. By removing the release layer 136 (not shown in FIG. 11) the first adhesive layer 132 beyond the periphery of support means 134 is exposed for attachment to the rear surface 34 of mask body 22. The device 118 is positioned with respect to mask 20 so that mask 20 occupies the desired position whereby the mask 20 covers the wearer's nose, mouth, chin and portions of both cheeks and attachment means 120 and support means 134 are positioned with respect to the top of the flare of the nostrils of the nose N of the wearer as shown in FIG. 12.

The manner of operation of the easier breathing device 118 is now set forth with respect to FIG. 12 which shows the nose N of a wearer of the facial surgical mask 20 and only the attachment means 120 and support means 134. The pliable central support means 122 of attachment means 120 be formed so that it conforms to the outer contour of the nose N and is then attached to the skin of the nose N by means of second adhesive layer 126. The combined weight of device 118 and mask 20 presses upon the outside of the nose N which tends to restrict or may even fully close the nasal passages interfering with or preventing breathing. The counter-balance strip or support means 134 is initially a flat strip and has an elastic memory which tends to return the strip 134 to its initial condition providing the modulus of elasticity of the strip has not been exceeded and the strip permanently deformed. The material from which strip 134 is fabricated, and its length, width and thickness are so chosen that the forces produced by strip 134 in trying to go from the arch shape shown in FIG. 11 to its initial flat shape equal the forces applied to the nose N by mask 20 and device 118. The forces produced by strip 134 are in the opposite direction to those applied by mask 20 and device 118 and thus cancel such forces. Accordingly, it is as if no forces are applied to the nostrils and there is no interference with the normal breathing of the mask wearer.

Figure 13:
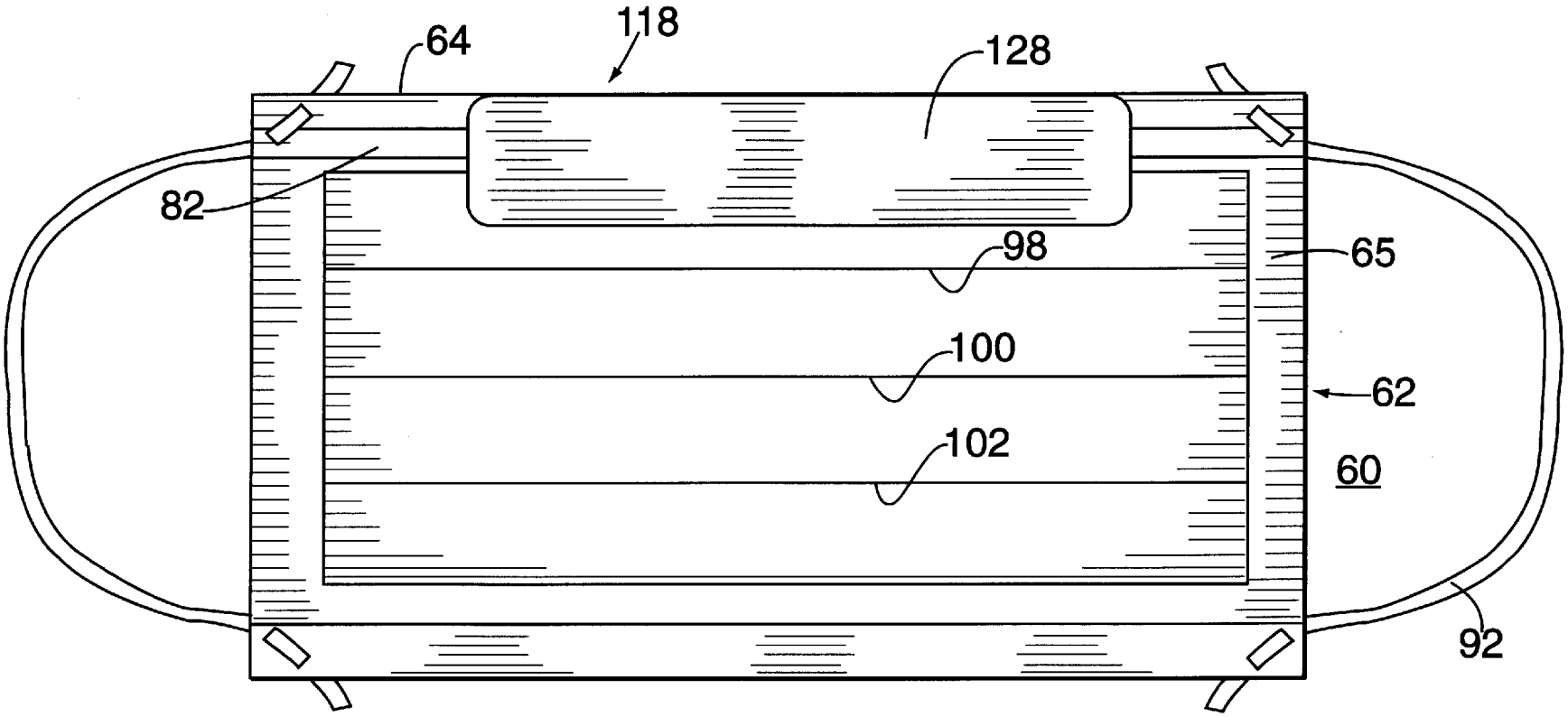
FIG. 13 is a rear elevational view of a rectangular-type facial mask similar to that shown in FIG. 6 and incorporating an easier breathing device constructed in accordance with the concepts of the invention.

FIG. 13 shows the placement of an easier breathing device 118 on a rectangular-type facial surgical mask 60. The top edge of device 118 is aligned with top edge 64 of the mask 60 and centered with respect to side edges 68 and 70. The metal strip 84 may be removed or allowed to deform as the mask 60 is applied providing it is not made to closely conform to the nose. The installation and use of device 118 will be substantially the same as described above with respect to FIGS. 9 to 12.

While there have been shown and described and pointed out the fundamental novel features of the invention as applied to the preferred embodiments, as are presently contemplated for carrying them out, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A facial surgical mask comprising:

a) body means having an inner surface, an outer surface and a free peripheral edge thereabout, said body means proportioned to fit over the nose, mouth, chin and portions of the cheeks of a wearer;

b) fastening means coupled to said body means for holding said body means in the desired position over said nose, mouth, chin and portions of the cheeks of such wearer after said body means has been placed in such desired position;

c) dual attachment means so configured to facilitate nasal dilation/breathing, said attachment means having a first surface and a second surface, said second surface coupled to said inner surface of said body means so positioned as to overlie a portion of the nose of a wearer; and d) further means on said first surface of said attachment means to attach said attachment means to the nose of the wearer.

2. A mask as defined in claim 1, wherein said body means is constructed of paper.

3. A mask as defined in claim 1, wherein said body means is constructed of cloth.

4. A mask as defined in claim 1, wherein said body means is constructed of a rubber material.

5. A mask as defined in claim 1, wherein said body means is constructed of plastic.

6. A mask as defined in claim 1, wherein said body means is formed into a generally cup-shape.

7. A mask as defined in claim 2, wherein said body means is formed into a generally cup-shape.

8. A mask as defined in claim 4, wherein said body means is molded into a generally cup-shape.

9. A mask as defined in claim 5, wherein said body means is molded into a generally cup-shape.

10. A mask as defined in claim 2, wherein said body means is formed by at least two inter-connected strips extending across the width of the face of a wearer, said strips being fan-folded with respect to one another and extendible in the direction of the length of the face of a wearer.

11. A mask as defined in claim 3, wherein said body means is formed by at least two interconnected strips extending across the width of the face of a wearer, said strips being fan-folded with respect to one another and extendible in the direction of the length of the face of a wearer.

12. A mask as defined in claim 1, wherein said fastening means comprises a band having a first end and a second end, said first band end connected to the outer surface of said body means adjacent said peripheral edge at a position to be adjacent one cheek of a wearer when said body means is in the desired position and said second band end connected to the outer surface of said body means at a position in-line with said first band end and to be adjacent the second cheek of a wearer when said body means is in the desired position, said band extending about the back of the head of a wearer between said first and second band ends.

13. A mask as defined in claim 1, wherein said fastening means comprises:

a) a first band segment having a first end and a first free end, said first end connected to the outer surface of said body means adjacent said peripheral edge at a position to be adjacent one cheek of a wearer when said body means is in the desired position; and b) a second band segment having a second end and a second free end, said second end connected to the outer surface of said body means adjacent said peripheral edge at a position in-line with said first band end and to be adjacent the second cheek of a wearer when said body means is in the desired position; said first and second free ends joined about the head of a wearer to maintain said mask in the desired position.

14. A mask as defined in claim 1, wherein said fastening means comprises:

a) a first U-shaped loop having first and second ends and a first curved portion therebetween, said first and second ends joined to said body means adjacent said peripheral edge and said first curved portion placed over the adjacent ear of said wearer when said body means is in the desired position; and b) a second U-shaped loop having third and fourth ends and a second curved portion therebetween, said third and fourth ends joined to said body means adjacent said peripheral edge in-line with said first and second ends at the opposite end of said body means and said second curved portion placed over the adjacent ear of said wearer when said body means is in the desired position, whereby said mask can be held in the desired position when said first and second curved portions of said fastening means are placed over the associated ears of a wearer.

15. A mask as defined in claim 1, wherein said attachment means second surface comprises a first layer of adhesive material.

16. A mask as defined in claim 1, wherein said further means on said first surface of said attachment means comprises a second layer of adhesive material.

17. A mask as defined in claim 15, wherein said first layer of adhesive material is a pressure sensitive adhesive.

18. A mask as defined in claim 16, wherein said second layer of adhesive material is a pressure sensitive adhesive.

19. A mask as defined in claim 18, wherein said pressure sensitive adhesive is covered with a removable release material.

20. A mask as defined in claim 1, wherein said attachment means comprises:

a) central support means having a first surface and a second surface;

b) said second surface of said attachment means having a first layer of adhesive material thereon; and c) said first surface of said attachment means having a second layer of adhesive material thereon.

21. A mask as defined in claim 20, wherein said first layer of adhesive material is a pressure sensitive adhesive.

22. A mask as defined in claim 20, wherein said second layer of adhesive material is a pressure sensitive adhesive.

23. A mask as defined in claim 20, wherein both of said first and second layers of adhesive material are pressure sensitive adhesives.

24. A mask as defined in claims 23, wherein said central support means is a foam layer and said second layer of adhesive material is covered with a layer of release material.

25. A mask as defined in claim 1, further comprising:

a) support means coupled to said inner surface of said body means to counterbalance any forces applied to nose of a wearer of said mask by said attachment means.

26. A mask as defined in claim 25, wherein said support means is located between said inner surface of said body means and said second surface of said attachment means.

27. A mask as defined in claim 25, wherein said support means is smaller than said attachment means and is coupled to said second surface of said attachment means and coupled to said inner surface of said body means by the remainder of said second surface of said attachment means not engaging said support means.

28. A mask as defined in claim 25, wherein said support means is an elongate member formed into an arch with two free ends and a central curved portion, said two free ends tending to separate from one another.

29. A mask as defined in claim 28, wherein said support means is fabricated from a resilient material.

30. A mask as defined in claim 29, wherein said support means is fabricated from a plastic material.

* * * * *